US005759307A

United States Patent [19]

Berger et al.

[11] Patent Number: 5,759,307

[45] Date of Patent: Jun. 2, 1998

[54] METHOD OF PRODUCING A COLD-ROLLED STRIP IN ONE PASS

[75] Inventors: Heinz Berger, Neunkirchen-Vluyn; Rolf Noé, Mülheim; Frank Bärhold, Quirmbach; Jörg Neumann, Ransbach-Baumbach; Andreas Noé, Mülheim; Ralf Waldmann, Rüscheid; Bodo Block, Rösrath, all of Germany

[73] Assignees: Keramchemie GmbH, Siershahn; BWG Bergwerk- und Walzwerk Maschinenbau GmbH, Duisberg, both of Germany

[21] Appl. No.: 708,084

[22] Filed: Aug. 30, 1996

[30] Foreign Application Priority Data

Sep. 1, 1995 [DE] Germany ..... 195 32 278.9

[51] Int. Cl.[6] ..... C21D 8/02

[52] U.S. Cl. ..... 148/603; 148/670

[58] Field of Search ..... 148/603, 670

[56] References Cited

FOREIGN PATENT DOCUMENTS 58-107212 6/1983 Japan ..... 148/603

62-260021 11/1987 Japan ..... 148/603

*Primary Examiner*—Deborah Yee

*Attorney, Agent, or Firm*—Friedrich Kueffner

[57] ABSTRACT

A method of producing a cold-rolled strip from a stainless, ferretic or austenitic high-grade steel or a titanium alloy, wherein the strip which has been wound into a coil and has been manufactured by a hot-rolling or casting process is subjected in one pass to the steps of unwinding the coil, mechanically descaling the strip if required, subsequently chemically and/or electrochemically first or black pickling of the strip, then cold-rolling the strip to finished dimensions, degreasing the strip as required, annealing the strip, finish-pickling the strip and, if necessary, passivating, dressing and stretcher-leveling the strip. The pickling step is carried out in a pickling solution which contains hydrochloric acid, sulfuric acid and/or nitric acid.

18 Claims, 1 Drawing Sheet

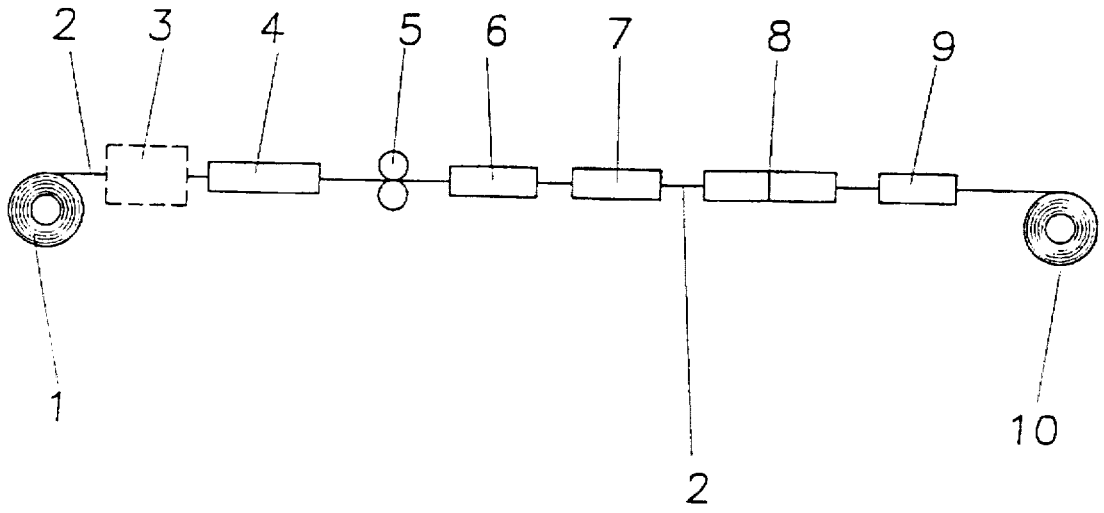
2
3
4
5
6
7
8
9
1
2
10

METHOD OF PRODUCING A COLD-ROLLED STRIP IN ONE PASS

BACKGROUND OF THE INVENTION

1. Field of the Invention

The present invention relates to a method of producing a cold-rolled strip from a stainless, ferretic or austenitic high-grade steel or a titanium alloy, wherein the strip which has been wound into a coil and has been manufactured by a hot-rolling or casting process is subjected in one pass to the steps of unwinding the coil, mechanically descaling the strip if required, subsequently chemically and/or electrochemically first or black pickling of the strip, then cold-rolling the strip to finished dimensions, degreasing the strip as required, annealing the strip, finish-pickling the strip and, if necessary, passivating, dressing and stretcher-leveling the strip.

2. Description of the Related Art

In the manufacture of a strip of high-grade steel which is subsequently processed into finished products, initially a relatively thick strip is produced by a hot-rolling process, wherein the strip is wound into a coil after the hot-rolling process. This coil is then transported to another production location, where it is unwound, annealed, mechanically descaled as necessary, and pickled. Mechanical descaling is carried out primarily by a blasting and brushing process, wherein the strip may travel through several pairs of brushes. Depending on the quality of the material, pickling of the not yet finished strip is carried out in a bath or in several baths having different pickling solutions, for example, sulfuric acid, hydrofluoric acid with additions without nitric acid, mixed acid (hydrofluoric acid/nitric acid mixture) or in electrolytic baths by means of sulfuric acid or a neutral salt. Subsequently, the pickled, not yet finished strip is again wound into a coil which is then, again at a different production location, rolled in a cold-rolling process to the finished thickness suitable for the finished product. After the cold-rolling process, the finished strip is again wound into a coil. This coil is then degreased, annealed and pickled, again at a different production location, wherein, for economical reasons, usually the same pickling plant and, thus, the same pickling solution are used as in the treatment of the hot-rolled strip. If necessary, after the last pickling process, the strip can be passivated, dressed and stretcher-leveled.

To avoid the repeated winding and unwinding of the strip which is unnecessary and especially time-consuming, it has been proposed to combine several treatment stages successively in one pass. In accordance with this proposal, the strip wound into a coil is unwound and is subjected in one pass to the steps of mechanically descaling, cold-rolling, degreasing, annealing, pickling, and, if necessary, passivating, dressing and stretcher-leveling. In this method, unnecessary winding and unwinding processes are avoided.

In addition, the pickling step prior to cold-rolling was to be omitted and by sufficiently blasting and brushing the strip, a surface quality of the strip prior to cold-rolling was to be achieved which, after the further treatment and processing steps, was to ensure that a quality of the finished strip was achieved which met the required specifications. For this purpose, blasting plants and multiple-axle brushing machines were used; these plants and machines were relatively complicated. However, even when using these complicated plants and machines, it was not possible to entirely prevent residual scale from remaining on the strip to be processed by a cold-rolling process, wherein this residual scale had a negative effect on the finished product. In order to prevent this residual scale, it was additionally proposed to carry out a first or black pickling step prior to the cold-rolling process, wherein the first pickling step was to be carried out in the same manner as the pickling of the hot-rolled strip by means of a mixed acid. However, experiments carried out with this method have shown that, while the strip is clean after the first pickling step, it has spots after finish-pickling which make the strip useless for further processing.

SUMMARY OF THE INVENTION

Therefore, it is the primary object of the present invention to provide a method of producing a strip of a stainless high-grade steel or a titanium alloy which can be processed into finished products, which method eliminates any spots on the finish-treated strip which make the strip useless, while maintaining the above-indicated advantages of a so-called integrated line in which the strip is subjected in one pass to the steps of chemically and/or electrochemically first pickling the strip, cold-rolling the strip to finished dimensions, degreasing the strip if necessary, annealing the strip, finish-pickling the strip and, if necessary passivating, dressing and stretcher-leveling the strip.

In accordance with the present invention, it is proposed that, in a method of the above-described type, the pickling step is carried out by means of a pickling solution which contains hydrochloric acid, sulfuric acid and/or nitric acid.

By carrying out the first pickling step in this manner, the strip is freed of scale to such an extent that an excellent quality of the finished product or of the finish treated strip is ensured. The first pickling step can be adapted in a special manner to the final pickling step. Thus, it is possible to use for the so called first or black pickling step a different pickling solution or combination of pickling solutions than for the so-called final pickling step, so that an optimum pickling result is achieved in a particularly economical manner.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a schematic illustration of a plant for producing a strip of high-grade steel which can be processed into finished products.

DESCRIPTION OF THE PREFERRED EMBODIMENTS

As shown in the drawing, a strip produced by a rolling process has initially been wound into a coil 1. The strip 2 is now unwound again from the coil 1. It is possible to conduct the strip 2 first through a descaling unit 3 in which the strip 2 is blasted and brushed. This descaling unit 3 may of be of relatively simple construction and may even be omitted. Following the descaling unit 3, the strip 2 is introduced into a pickling unit 4 which is composed at least of a pickling container with a pickling solution and forms the so-called first or black pickling stage.

The pickling unit 4 is followed by at least one cold-rolling stand 5 in which the strip 2 is reduced to the desired thickness. Thereafter, the cold-rolled strip is conducted through a degreasing unit 6 and an annealing unit 7 and then reaches another pickling unit 8 which is composed of at least two flat containers. In the pickling unit 8, the strip 2 is finish-pickled in the conventional manner. Subsequently, if necessary, the strip 2 is passivated, dressed and stretcher-leveled in a unit 9.

Appropriate samples of high-grade steel were subjected to a first pickling step by initially treating the samples over a period of time of approximately 45 seconds with a pickling solution which contained approximately 130 g/l free hydrochloric acid as well as 90 g/l total iron and had a temperature of approximately 80° C.; the iron was present in the solution as bivalent iron or trivalent iron. Under these conditions, a clean, completely descaled, shiny surface of the samples was achieved. The cold-rolling process and a subsequent annealing step were followed by final pickling which was carried out initially in the conventional manner electrochemically by means of a sulfuric acid-containing pickling solution and subsequently by means of mixed acids. The finally pickled samples were problem-free. It was possible to substantially reduce the treatment times by changing the physical conditions, for example, applying the pickling solution by a spraying process or by a combination of immersion pickling and spray pickling.

When the first pickling step was carried out with a sulfuric acid-containing solution, this solution contained approximately 290 g/l free sulfuric acid and had an iron content of approximately 25 g/l. The temperature of this pickling solution was about 100° C. After a treatment period of approximately 40 seconds, the samples had after the first pickling step a brown/gray surface color which had an advantageous effect on the subsequent annealing zone. No problems occurred during the cold-rolling process. The so-called final pickling step was then again carried out initially electrochemically in a sulfuric acid-containing pickling solution and subsequently in mixed acids. The quality of the samples was also problem-free in this case.

Finally, samples were treated with a nitric acid-containing pickling solution which contained approximately 20% free nitric acid and approximately 30 g/l free iron. The temperature of the pickling solution was approximately 60° C. and the pickling time was approximately 30 seconds. In the case of these samples, the nitric acid-containing pickling solution was applied by means of a spraying process, while turbulence was produced in a pickling solution used for other samples. After the so-called first or black pickling, the samples had a slightly brightened surface, however, scale residues could still be detected on the surface. However, these scale residues do not have a disadvantageous effect on the subsequent treatments. After finish pickling, the surface was again shiny and free of scale.

When experiments were carried out with a nitric acid-containing pickling solution which contained approximately 16–17% nitric acid, it was found that the first spots could be seen on the finished samples when 0.75% hydrofluoric acid were added to the solution, wherein the spots occurred regularly when approximately 3% or more hydrofluoric acid were added.

While specific embodiments of the invention have been shown and described in detail to illustrate the inventive principles, it will be understood that the invention may be embodied otherwise without departing from such principles.

We claim:

1. In a method of producing a cold-rolled strip of a stainless austenitic high-grade steel or a titanium alloy, the method including carrying out in one pass the steps of unwinding a coil produced by a hot-rolling or casting procedure and wound into a coil, subsequently subjecting the strip to a chemical and/or electrochemical first pickling step, and then cold-rolling the strip to finished dimensions, and annealing and finish-pickling the strip, the improvement comprising carrying out the first pickling step with a pickling solution containing at least one of hydrochloric acid, sulfuric acid and hydrofluoric acid.

2. The method according to claim 1, comprising carrying out the first pickling step and the finish-pickling step in separate pickling containers with different pickling solutions.

3. The method according to claim 1, comprising carrying out the first pickling step in at least one pickling container with a pickling solution mixture.

4. The method according to claim 1, comprising carrying out the first pickling step with a hydrochloric acid-containing pickling solution which contains at most 25% free hydrochloric acid and has a temperature of approximately 50°–90° C.

5. The method according to claim 4, wherein the hydrochloric acid-containing solution contains 10–17% free hydrochloric acid and has a temperature of 75°–85° C.

6. The method according to claim 1, carrying out the first pickling step with a sulfuric acid-containing pickling solution containing at most 45% free sulfuric acid and having a temperature of between 70° C. and slightly below the boiling point of sulfuric acid.

7. The method according to claim 6, wherein the sulfuric acid-containing pickling solution contains 20–30% free sulfuric acid and has a temperature of 95°–105° C.

8. The method according to claim 6, comprising carrying out the first pickling step so as to produce a dark coating on the surface of the strip.

9. The method according to claim 1, comprising carrying out the first pickling step with a nitric acid-containing pickling solution containing at most 30% free nitric acid and having a temperature of approximately 30°–90° C.

10. The method according to claim 9, comprising carrying out the first pickling step so as to produce a layer of residual scale on the surface of the strip.

11. The method according to claim 1, comprising carrying out the first pickling step with a pickling solution containing less than 0.75% free hydrofluoric acid.

12. The method according to claim 1, comprising supplying at least the pickling solution containing hydrochloric acid to the strip with at least one spraying process.

13. The method according to claim 12, comprising guiding the strip through an immersion pickling bath between two successive spraying processes.

14. The method according to claim 1, comprising carrying out the first pickling step electrochemically with a current density of up to 50 $A/dm^2$.

15. The method according to claim 14, wherein the current density is 10–20 $A/dm^2$.

16. The method according to claim 1, comprising mechanically descaling the strip prior to the first pickling step.

17. The method according to claim 1, comprising degreasing the strip after cold-rolling the strip.

18. The method according to claim 1, comprising passivating, dressing and stretcher-leveling the strip after the finish-pickling step.

* * * * *